US008478174B2

(12) United States Patent
Ideguchi

(10) Patent No.: US 8,478,174 B2
(45) Date of Patent: Jul. 2, 2013

(54) IMAGE FORMING APPARATUS

(75) Inventor: Takuro Ideguchi, Munich (DE)

(73) Assignee: Canon Kabushiki Kaisha, Tokyo (JP)

( * ) Notice: Subject to any disclaimer, the term of this patent is extended or adjusted under 35 U.S.C. 154(b) by 468 days.

(21) Appl. No.: 12/899,151

(22) Filed: Oct. 6, 2010

(65) Prior Publication Data

US 2011/0110692 A1 May 12, 2011

(30) Foreign Application Priority Data

Nov. 9, 2009 (JP) ..... 2009-256233

(51) Int. Cl.
*G03G 15/20* (2006.01)
*G03G 15/00* (2006.01)

(52) U.S. Cl.
USPC ..... 399/312; 399/397

(58) Field of Classification Search
USPC ..... 399/121, 312, 397–398, 400
See application file for complete search history.

(56) References Cited

FOREIGN PATENT DOCUMENTS

| | | | |
|---|---|---|---|
| JP | 05-119636 | A | 5/1993 |
| JP | 06-211376 | A | 8/1994 |
| JP | 08-113408 | A | 5/1996 |
| JP | 09-305032 | A | 11/1997 |
| JP | 2000-242090 | A | 9/2000 |
| JP | 2005-173330 | A | 6/2005 |

*Primary Examiner* — David Gray
*Assistant Examiner* — Andrew Do
(74) *Attorney, Agent, or Firm* — Canon USA Inc IP Division

(57) ABSTRACT

An image forming apparatus includes a separation supporting unit for forming undulations on a recording material bearing member, and a roller disposed between the separation supporting unit and a transfer nip and configured to stretch the recording material bearing member.

6 Claims, 11 Drawing Sheets

IMAGE FORMING APPARATUS

BACKGROUND OF THE INVENTION

1. Field of the Invention

The present invention relates to a technique for transferring a toner image formed on an image bearing member to a recording material by using the electrophotographic process, and also to a technique for separating a thin recording material from a transfer belt conveying the recording material, used in image forming apparatuses such as copying machines and laser beam printers.

2. Description of the Related Art

In recent years, there has been a demand for application of diverse types of recording materials to image forming apparatuses utilizing the electrophotographic process, such as copying machines and laser beam printers. For example, there has been a demand for application of a recording material having a low stiffness, such as thin paper, to image forming apparatuses. However, because of a low stiffness, the use of such thin paper requires a recording material conveyance system that can ensure high stability.

To meet such a demand, an applied technique electrostatistically attracts a recording material to the transfer belt conveying the recording material to allow it to pass through a transfer nip portion.

However, when such a technique is applied to a recording material having a low stiffness, a paper sheet sticks to the transfer belt at the leading end of a separation roller, where the recording material should be separated from the transfer belt, resulting in separation failure.

As a method for solving this problem, undulating the transfer belt at a separation position makes the recording material stiffer, improving the separation between the recording material and the transfer belt. More specifically, projections are uniformly formed on the surface of the separation roller that supports the transfer belt at the separation position (Japanese Patent Application Laid-Open No. 8-113408). However, when the thus-configured separation roller is used to form undulations on the transfer belt, the separation roller will locally apply large tension to the transfer belt on a constant basis. As a result, resistance unevenness due to local wear on the transfer belt causes unstable transferability.

Japanese Patent Application Laid-Open No. 5-119636 discusses a technique for deforming a sheet-like transfer drum while reducing wear due to deformation. With the technique in Japanese Patent Application Laid-Open No. 5-119636, there is provided a roller movable to a position where the sheet surface on the transfer drum is raised from the inner side and a position where it is not raised. While the recording material is not separated, the sheet surface is not raised. When the recording material is separated from the sheet surface, the sheet surface is raised.

When this configuration is applied to the transfer belt, a raising means for locally raising the transfer belt at the time of separation process is disposed on the upstream side of the separation roller. With an extremely thin recording material, conveying the recording material with the transfer belt locally raised deforms the transfer belt and recording material, making the recording material stiffer. This configuration allows even an extremely thin recording material to be separated from the transfer belt.

However, when the raising means locally raises the transfer belt, if the influence of deformation on the belt surface of the transfer belt reaches a transfer portion, the transfer nip portion becomes unstable possibly resulting in transfer failure.

SUMMARY OF THE INVENTION

The present invention is directed to an image forming apparatus capable of reducing the influence of the deformation of a transfer belt caused by a raising means on a transfer portion.

According to an aspect of the present invention, an image forming apparatus includes: an image bearing member; a rotatable belt member stretched; a transfer member configured to form a transfer portion for transferring a toner image formed on the image bearing member onto a recording material conveyed by the belt member; a separation roller configured to stretch the belt member and enable separating the recording material borne by the belt member from the belt member; a raising unit configured to enable locally raising a belt surface in the width direction of the belt member to separate the recording material borne by the belt member from the belt member, the belt surface being on the upstream side of separation supporting rollers and on the downstream side of the transfer portion in the rotational direction of the belt member; and a pre-separation stretching member disposed on the downstream side of the transfer portion and on the upstream side of a contact portion between the raising unit and the belt member in the rotational direction, and configured to stretch the belt member at least when the raising unit raises the belt member.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

<Image Forming Apparatus>

An image forming apparatus according to the present invention will be described below.

Figure 1:
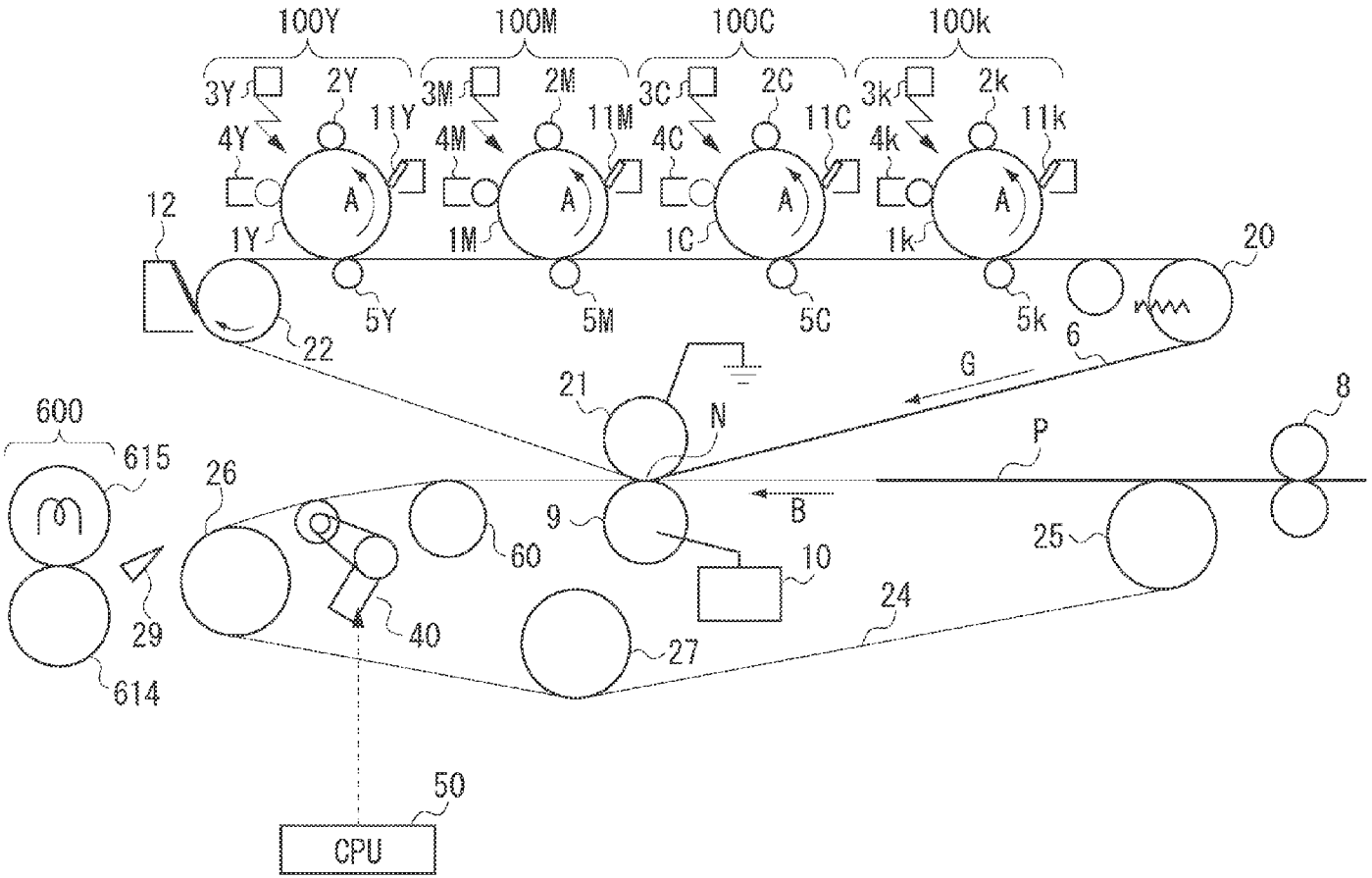
FIG. 1 is schematic view of an image forming apparatus.

First of all, the configuration and operation of the image forming apparatus will be described below with reference to FIG. 1. The image forming apparatus illustrated in FIG. 1 is a color image forming apparatus utilizing the electrophotographic process. FIG. 1 is a sectional view illustrating the image forming apparatus including so-called intermediate transfer tandem system in which four-color image forming units are arranged on an intermediate transfer belt.

Image forming units 100 will be described below. In the present exemplary embodiment, the image forming apparatus includes known image forming units 100Y, 100M, 100C, and 100*k*. Each of the four image forming units will be described below.

Each of photosensitive drums 1Y, 1M, 1C, and 1*k* is an image bearing member that is rotatable in the direction of an arrow A. Charging units 2Y, 2M, 2C, and 2*k* charge the photosensitive drums 1Y, 1M, 1C, and 1*k*, respectively. Exposure units 3Y, 3M, 3C, and 3*k* perform image exposure on the photosensitive drums 1Y, 1M, 1C, and 1*k*, respectively, based on input image information.

Developing units 4Y, 4M, 4C, and 4*k* develop an image on the photosensitive drums 1Y, 1M, 1C, and 1*k*, respectively. More specifically, the developing unit 4Y develops an image by using yellow (Y) toner, the developing unit 4M develops an image by using magenta (M) toner, the developing unit 4C develops an image by using cyan (C) toner, and the developing unit 4*k* develops an image by using black (k) toner. Cleaning units 11Y, 11M, 11C, and 11*k* remove residual toner on the photosensitive drums 1Y, 1M, 1C, and 1*k*, respectively, after the transfer process.

An intermediate transfer belt 6 (intermediate transfer member or image bearing member) facing respective photosensitive drums will be described below.

The intermediate transfer belt 6 is stretched by a plurality of stretching rollers 20, 21, and 22 (stretching members) so that the intermediate transfer belt 6 rotates in the direction of an arrow G. In the present exemplary embodiment, the stretching roller 20 is a tension roller for applying a tension to the intermediate transfer belt 6 to maintain its tension constant. The stretching roller 22 is a drive roller for transmitting the driving force to the intermediate transfer belt 6. The stretching roller 21 is an inner facing roller for forming a secondary transfer portion.

Primary transfer rollers 5Y, 5M, 5C, and 5*k* (primary transfer members) are disposed on the inner side of the intermediate transfer belt 6. The primary transfer rollers 5Y, 5M, 5C, and 5*k* transfer a toner image formed on the photosensitive drums 1Y, 1M, 1C, and 1*k*, respectively, to the intermediate transfer belt 6. With the above-mentioned configuration, four color toner images are transferred to the intermediate transfer belt 6 in a superimposition manner to form one toner image, and then conveyed to the secondary transfer portion.

The configuration of a secondary transfer portion N for transferring the toner image formed on the intermediate transfer belt 6 to a recording material P will be described below.

The secondary transfer portion N includes the inner facing roller 21 (primary transfer member) and an outer facing roller 9 (secondary transfer member). The inner facing roller 21 is disposed on the inner side of the intermediate transfer belt 6. The outer facing roller 9 applies pressure to the inner facing roller 21 from the outer side of the intermediate transfer belt 6 via the intermediate transfer belt 6 and a transfer belt 24. When a voltage having a polarity opposite to the regular charging polarity of toner is applied to the outer facing roller 9 by a secondary transfer high-voltage power supply 13, the toner image is transferred to the recording material P. A conveyance portion for conveying the recording material P will be described below.

The toner image formed on the intermediate transfer belt 6 is transferred to the recording material P that is fed from a registration roller pair 8 to the transfer belt 24 at a predetermined timing and then conveyed to the secondary transfer portion N. Then, the recording material P is conveyed to a recording material guide 29, and further conveyed to a fixing unit 600. The fixing unit 600 heats and pressurizes the recording medium P in a fixing nip portion formed of a fixing roller 615 and a pressurization roller 614 (facing each other in FIG. 1) to melt and fix the toner image on the recording material P.

<Configuration of Transfer Belt>

The transfer belt 24 (belt member) conveys the recording material P. The transfer belt 24 is stretched by a plurality of stretching rollers 25, 26, 27, and 60 (stretching members) so that the transfer belt 24 rotates in the direction of an arrow B. In the present exemplary embodiment, the stretching roller 26 serves as a drive roller for transmitting the driving force to the transfer belt 24. The stretching rollers 25, 27, and 60 rotate following the rotation of the transfer belt 24. The stretching rollers 25, 26, and 27 are cylindrical rollers.

The recording material P conveyed from the registration roller pair 8 starts contacting the transfer belt 24 on the surface thereof on the upstream side of the secondary transfer portion N in the moving direction of the transfer belt 24. The present exemplary embodiment is not provided with an attracting means such as an attracting roller for electrostatistically attracting the recording material P to the transfer belt 24. However, the recording material P may be attracted to the transfer belt 24 by using an attracting means.

The recording material P placed on the belt surface of the transfer belt 24 on the upstream side of the secondary transfer portion N is then conveyed to the secondary transfer portion N with the movement of the transfer belt 24. After the toner image has been transferred onto the recording material P at the secondary transfer portion N, the recording material P is separated from the transfer belt 24. In the present exemplary embodiment, when the grammage of the recording material P is larger than a predetermined value, a separation supporting unit 40 (described below) does not operate. In this case, the recording material P is separated from the transfer belt 24 by the curvature of the stretching roller 26.

The stretching roller 26 serves as a separation roller for separating the recording material P borne by the transfer belt 24 therefrom. On the other hand, when the grammage of the recording material P is smaller than the predetermined value, the separation supporting unit 40 (described below) operates to separate the recording material P from the transfer belt 24.

The transfer belt 24 used in the present exemplary embodiment is made of resin, such as polyimide and polycarbonate, or various types of rubbers containing a suitable quantity of carbon black as an antistatic agent. The transfer belt 24 has a volume resistivity of 1E+9 to 1E+14 Ωcm and a thickness of 0.07 to 0.1 mm.

Further, the transfer belt 24 is made of an elastic member having a Young's modulus value of 0.5 to 10 MPa measured with the tensile test method (JIS K 6301). Further, the use of a member having a Young's modulus value of 0.5 MPa or more measured with the tensile test allows the transfer belt 24 to be driven and rotated while sufficiently maintaining its shape.

On the other hand, the use of a member having a Young's modulus value of about 10 MPa or less and enabling sufficient elastic deformation can locally deform the transfer belt 24 by the separation supporting unit 40, allowing the recording material P to be separated from the transfer belt 24. Further, when elastic deformation of the transfer belt 24 is enabled, the transfer belt 24 is likely to be loose when the separation supporting unit 40 is retracted. Therefore, the duration life of the transfer belt 24 can be prevented from being shortened by the separation supporting unit 40.

The present exemplary embodiment is provided with the separation supporting unit 40 as means for locally raising the transfer belt 24 for deformation to separate the recording material P therefrom. The separation supporting unit 40 is disposed on the downstream side of the secondary transfer portion N and on the upstream side of the stretching roller 26 in the recording material conveyance direction, and on the inner side of the transfer belt 24.

Figure 2B:
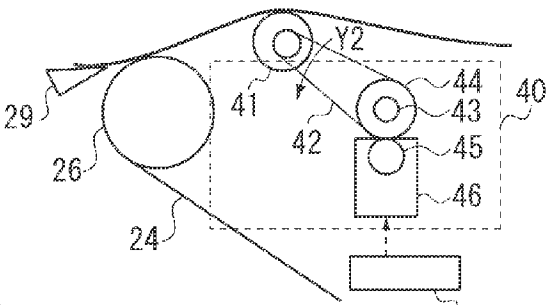
FIGS. 2A and 2B are sectional views illustrating a relation between a separation unit and the transfer belt.
Figure 2A:
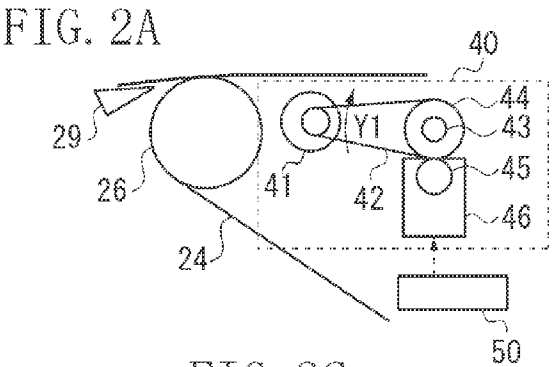
Figure 2C:
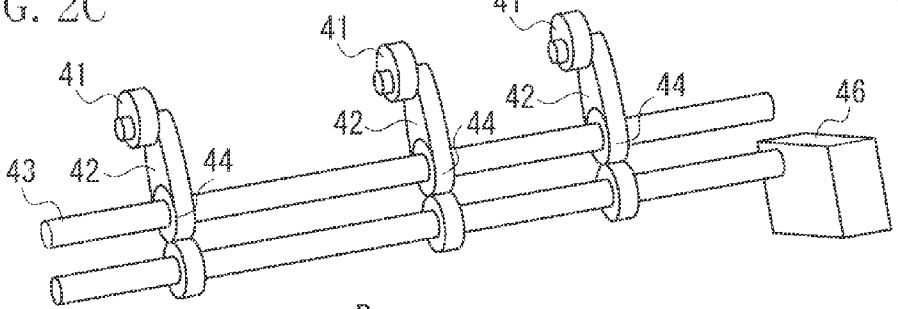
FIGS. 2C and 2D are perspective views illustrating the separation unit.

FIGS. 2A, 2B, and 2C illustrate in detail the configuration and operation of the separation supporting unit 40. The separation supporting unit 40 includes separation supporting rollers 41, which are separation supporting members, and roller frames 42, which rotatably support the separation supporting rollers 41. The separation supporting unit 40 further includes a roller swing center shaft 43, which serves as a center of the swing of the separation supporting rollers 41, roller drive gears 44, which swing and move the separation supporting rollers 41 centering on the roller swing center shaft 43, a motor drive transmitting gear 45, which transmits the driving force to the roller drive gears 44, and a motor 46, which is a drive source.

The motor drive transmitting gear 45 transmits the driving force from the motor 46 to the roller drive gears 44. Since a bearing is provided between each roller drive gear 44 and the roller swing center shaft 43, the roller swing center shaft 43 is not subjected to the influence of the rotation and drive of the motor 46, and therefore its position remains unchanged.

FIG. 2C is a perspective view illustrating the separation supporting unit 40. The separation supporting rollers 41 are movably arranged in the width direction of the transfer belt 24. The width direction is a direction perpendicularly intersecting with the moving direction of the belt surface of the transfer belt 24.

When the motor 46 rotates in the forward direction by a predetermined amount, the separation supporting rollers 41 and the roller frames 42 can move in the Y1 direction, centering on the roller swing center shaft 43, from a roller retracting position illustrated in FIG. 2A to a position illustrated in FIG. 2B where the separation supporting rollers 41 contact the inner side of the transfer belt 24. In addition, when the motor 46 rotates in the reverse direction by a predetermined amount, the separation supporting rollers 41 can move in the Y2 direction from a belt raised position illustrated in FIG. 2B to the roller retracting position illustrated in FIG. 2A where the separation supporting rollers 41 are separated from the inner side of the transfer belt 24 and retracted. The separation supporting rollers 41 make a swing movement in this way.

Each of the separation supporting rollers 41 is made of ethylene-propylene rubber (EPDM) having an outer diameter of 6 to 10 mm and a major width of about 5 to 15 mm. When the separation supporting rollers 41 raise the transfer belt 24, local projections are formed on the transfer belt 24 in the width direction thereof. To reduce wear on the inner side of the transfer belt 24, the separation supporting rollers 41 are desirably elastic members made of rubber.

In the state illustrated in FIG. 2A (separation state), the distance from each separation supporting roller 41 to the transfer belt 24 is 4 to 8 mm. In the present exemplary embodiment, the distance between each separation supporting roller 41 and the transfer belt 24 in the separation state is set to reliably prevent contact therebetween. However, the distance is not limited thereto.

In the state illustrated in FIG. 2B (raised state), the amount of movement of each separation supporting roller 41 is set so that the belt surface of the transfer belt 24 is raised from the inner side by 3 to 6 mm. In the present exemplary embodiment, the amount of movement of the separation supporting rollers 41 is set to ensure the raised state of the belt surface of the transfer belt 24. However, the amount of movement is not limited thereto.

The amount of raise is determined with reference to the belt surface in the separation state. To accomplish the above configuration, a regulating member for regulating the amount of movement may be provided, or the amount of movement of the motor shaft may be preset.

In the state illustrated in FIG. 2A, since a plurality of separation supporting rollers 41 locally raises the transfer belt 24, a level difference arises between a portion pressed up by a separation supporting roller 41 and a portion not pressed up. As a result, the belt surface of the transfer belt 24 is undulated and deformed.

In the present exemplary embodiment, the separation supporting rollers 41 are separated from the transfer belt 24 in the separation state. However, the separation supporting rollers 41 may be in contact with the transfer belt 24 to such an extent that its surface shape remains unaffected, in other words, the belt surface of the transfer belt 24 is not undulated in the width direction thereof by the separation supporting rollers 41. More specifically, it is necessary that the maximum level difference is 0.5 mm or less.

When a recording material having a preset thickness is conveyed, the transfer belt 24 is locally deformed in the width direction by being raised by the separation supporting rollers 41. The transfer roller 9 applies to the inner side of the transfer belt 24 electric charges having a polarity opposite to that of toner. Therefore, the recording material P sticks to the transfer belt 24 at least by the influence of electrostatic transfer at the secondary transfer portion N.

Figure 2D:
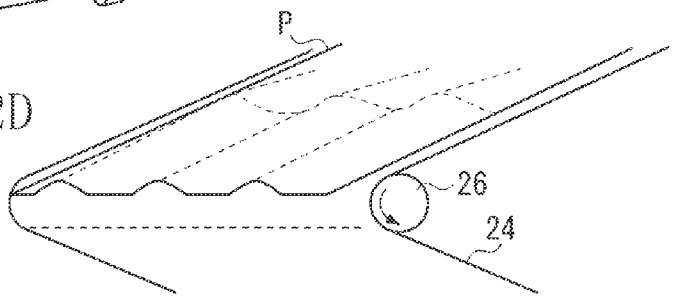

A recording material having a low stiffness is not stiff and therefore easy to be deformed. Therefore, as illustrated in FIG. 2D, the recording material is undulated as the transfer belt 24 is deformed. As a result, the geometric moment of inertia, i.e., the stiffness of the recording material increases. Thus, effective measures for separating thin recording material having an extremely low stiffness can be obtained.

As illustrated in FIG. 2C, in the present exemplary embodiment, a plurality of separation supporting rollers 41 is arranged at certain intervals in the width direction. The separation supporting rollers 41 in the present exemplary embodiment are arranged in the following manner. The separation supporting roller 41 at the middle position is disposed at the approximately center portion of a recording material of any size that is conveyed in such a manner that the lateral center substantially coincides with a common reference line.

The separation supporting rollers 41 at both ends are disposed at both lateral end positions within a passage area of a feedable recording material having a preset maximum size.

A feedable recording material having a preset maximum size is a recording material having a maximum size usable for image formation by the image forming apparatus described in the specification thereof. Although only one separation supporting roller 41 may be disposed in the passage area, however, it is preferable that a plurality of separation supporting rollers 41 is disposed in the passage area.

When the interval between a plurality of separation supporting rollers 41 in the width direction is too small, the transfer belt 24 will be entirely raised. In this case, since local projections are not formed on the transfer belt 24, the separation between the recording material and the transfer belt cannot be improved.

To form local projections, it is necessary to arrange the separation supporting rollers 41 with certain intervals, so that, in the present exemplary embodiment, the widths of the separation supporting rollers 41 and the intervals therebetween are determined.

Figure 3:
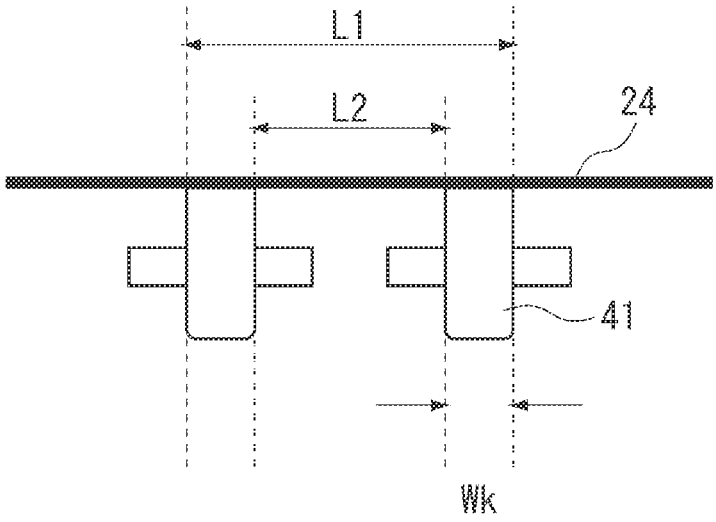
FIG. 3 illustrates separation supporting rollers.

FIG. 3 illustrates the widths of the separation supporting rollers 41 and the interval therebetween. Referring to FIG. 3, two separation supporting rollers 41 each having a top width of Wk are arranged at an interval L1 between far-side edges, and at an interval L2 between near-side (facing) edges that equals to (L1−2Wk).

In the present exemplary embodiment, L2 is set to a value equal to or larger than 2Wk. More specifically, the length over which the separation supporting rollers 41 do not contact the transfer belt 24 is larger than the length over which they contact the transfer belt 24. The transfer belt 24 is likely to be locally deformed rather than being entirely raised, making it easier to form undulations on the transfer belt 24.

In the present exemplary embodiment, three separation supporting rollers 41 are arranged in the width direction at an interval of 110 mm between the middle separation supporting roller 41 and an adjacent separation supporting roller 41. The recording material P is conveyed so that the lateral center of the recording material P coincides with the lateral center of the middle separation supporting roller 41.

When the separation supporting rollers 41 are arranged in this way, a plurality of projections corresponding to the minimum size (postcard size) to the maximum size (330-mm width) are formed on the transfer belt 24 as the recording material size in the width direction recommended to be conveyed. For example, when the size of the conveyed recording material P in the width direction is the minimum size (postcard size or 10 mm), a convex undulation is formed on the recording material P at a projection formed on the transfer belt 24 by the middle separation supporting roller 41. This convex undulation on the recording material P increases its stiffness, which allows the recording material P to be separated from the transfer belt 24.

When conveying the recording material P having the maximum size (330 mm) in the width direction, three projections are formed on the transfer belt 24 by the three separation supporting rollers 41, and a concave undulation is formed between projections on the recording material P.

When an identical undulation is formed on large- and small-size recording materials, the stiffness of the large-size recording material will decrease more since it has a larger weight and therefore is affected more by the gravity than the small-size recording material. For this reason, it is desirable to use a plurality of separation supporting rollers 41 for large-size recording materials.

In the present exemplary embodiment, the width of the recording material is 330 mm and the interval between the separation supporting rollers at both ends is 220 mm which is shorter than the width of the recording material. Convex portions of the separation supporting rollers 41 can reliably form undulations on the recording material by making the interval between the separation supporting rollers at both ends shorter than the width of the recording material.

Figure 4:
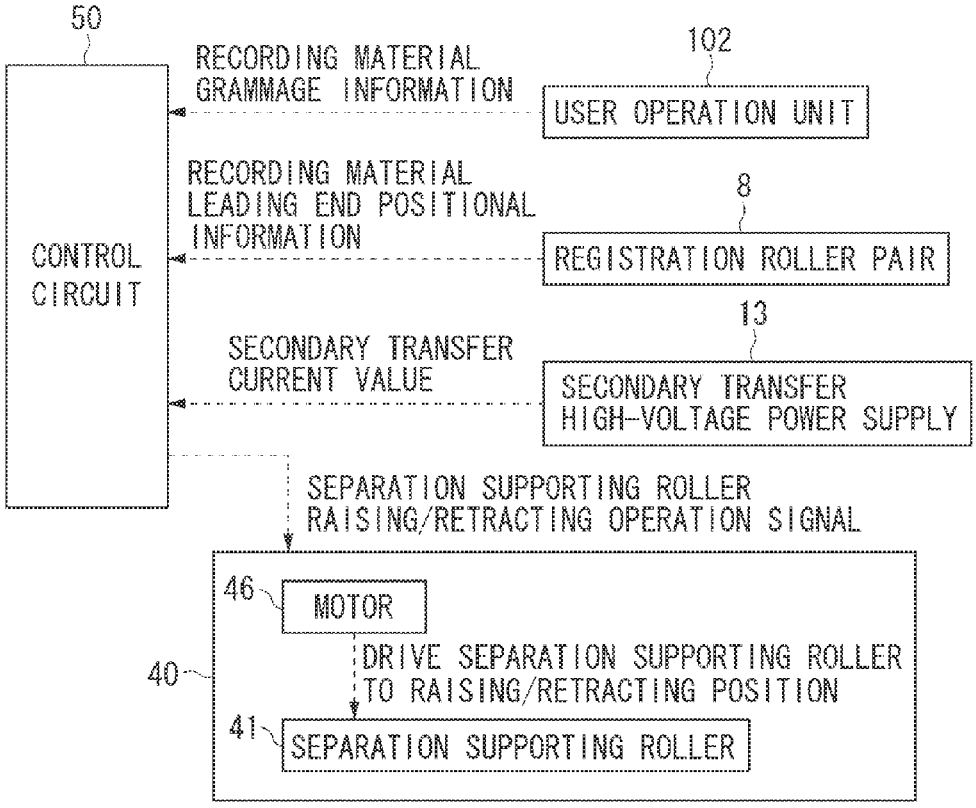
FIG. 4 is a block diagram illustrating an image forming apparatus according to a first exemplary embodiment of the invention.

The operating position of the separation supporting unit 40 is controlled by a control unit 50. FIG. 4 illustrates a relation between the control unit 50 and the separation supporting unit 40. The control unit 50 performs operating position control for the separation supporting unit 40 based on recording material grammage information specified by a user, recording material leading end positional information acquired at a recording material conveyance timing of the registration roller pair 8, and a secondary transfer current value read by the secondary transfer high-voltage power supply 13.

The block diagram in FIG. 4 will be described below. In the present exemplary embodiment, the control unit 50 includes a central processing unit (CPU), a read-only memory (ROM), and a random access memory (RAM). The control unit 50 receives information from an operation unit 102 with which the user operates the above-mentioned image forming units. The control unit 50 also receives an operation timing of the registration roller pair 8 and the secondary transfer current value from the secondary transfer high-voltage power supply 13. At the same time, the control unit 50 controls the operation of the motor of the separation supporting unit 40.

Figure 5A:
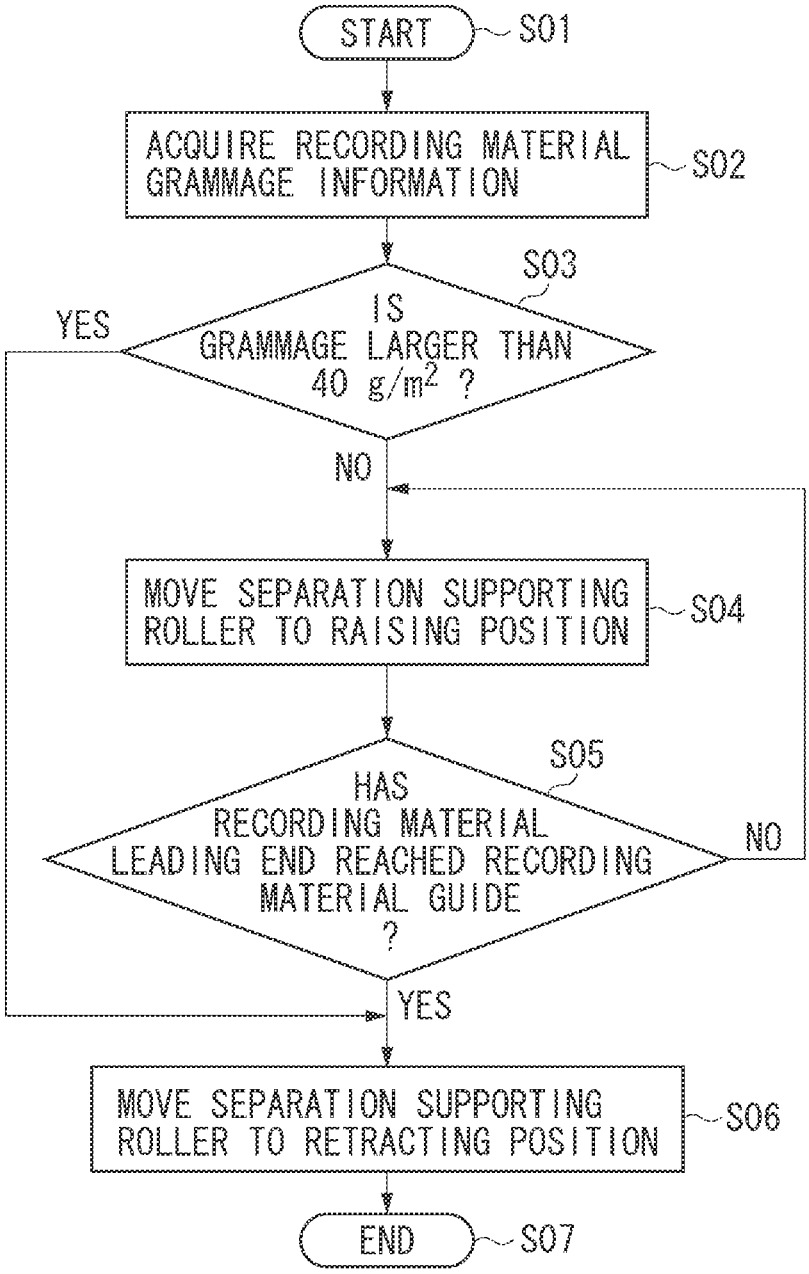
FIGS. 5A and 5B are a flow chart and a timing chart illustrating processing according to the first exemplary embodiment, respectively.

Operating position control for the separation supporting unit 40 is performed based on the flow chart illustrated in FIG. 5A according to the grammage of the recording material.

In the present exemplary embodiment, the following two different patterns are pre-stored in the ROM.

With a grammage of 40 g/m$^2$ or less, the separation supporting rollers 41 locally deform the transfer belt 24.

With a grammage exceeding 40 g/m$^2$, the separation supporting rollers 41 are separated from the transfer belt 24. Herein, the grammage of the recording material represents the weight of the recording material per 1 m$^2$ (unit area).

The control unit 50 determines the operation of the separation supporting unit 40 based on information about the grammage of the recording material input by the user via the operation unit 102, or input when the user input the grammage of the stored recording materials in the storage unit to the image forming apparatus.

Although the grammage is used as a unit of stiffness of the recording material in the present exemplary embodiment, the unit of stiffness is not limited thereto, and may be the thickness of the recording material. The larger the grammage of the recording material, the larger the stiffness thereof. The smaller the grammage of the recording material, the smaller the stiffness thereof. Referring to a relation between the stiffness and thickness of the recording material, the thicker the recording material, the larger the stiffness thereof. Conversely, the thinner the recording material, the smaller the stiffness thereof.

When the thickness of the recording material is used as a unit of stiffness in this way, a known thickness detection sensor for detecting the thickness of the recording material is disposed on the upstream side of the registration roller pair 8 in the conveyance direction of the recording material, and the control unit 50 controls the operation of the separation supporting unit 40 based on the output of the thickness detection sensor.

A flow chart for controlling the operation of the separation supporting unit 40 will be described below with reference to FIG. 5A. Referring to FIG. 5A, in step S01, the control unit 50 starts controlling the operation of the separation supporting unit 40 when an image forming signal is input. In step S02, the control unit 50 reads information about the grammage of the recording material used for image formation, i.e., the recording material grammage information set by the user via the user operation unit 102 in the present exemplary embodiment.

In step S03, the control unit 50 determines whether the read grammage is larger than 40 g/m$^2$. When the control unit 50 determines that the grammage of the recording material is 40 g/m$^2$ or less (NO in step S03), the control unit 50 controls the separation supporting unit 40 to raise the transfer belt 24 to form projections thereon to separate the recording material P from the transfer belt 24.

In step S04, the separation supporting rollers 41 are moved in the Y1 direction up to the raising position where the transfer belt 24 is raised by the separation supporting rollers 41. On the transfer belt 24 deformed by the separation supporting rollers 41, the recording material P is undulated and its stiffness increases accordingly. As a result, the recording material P is separated from the transfer belt 24 before it reaches the stretching roller 26.

When the control unit 50 determines that the grammage of the recording material P is larger than 40 g/m$^2$ (YES in step S03), the processing proceeds to step S06. In step S06, the control unit 50 moves the separation supporting rollers 41 to the retracting position. In step S05, the control unit 50 determines whether the leading end of the recording material P has reached the recording material guide 29.

In the present exemplary embodiment, the recording material guide 29 is provided with a recording material detection sensor (not illustrated). The control unit 50 determines whether the leading end of the recording material P has reached the recording material guide 29 using the recording material detection sensor. The position of the recording material P may be detected by another method, for example, through counting from a predetermined point instead of providing the recording material detection sensor to the recording material guide 29.

When the recording material P has reached the recording material guide 29 (YES in step S05), the control unit 50 determines that the recording material P has been separated, and the processing proceeds to step S06. In step S06, the control unit 50 moves the separation supporting rollers 41 to the retracting position. In step S07, the control unit 50 ends the processing. On the other hand, when the recording material detection sensor does not detect the recording material P (NO in step S05), the control unit 50 determines that the recording material P has not reached the recording material guide 29, and the processing proceeds to step S04. In step S04, the control unit 50 raises the separation supporting rollers 41 to make separation.

In the present exemplary embodiment, the separation supporting rollers 41 are raised in a specific case. Since the present exemplary embodiment is to be considered as an example, other grammage values may be used.

The above-mentioned configuration enables various types of recording materials to be separated from the transfer belt 24.

Timing for operating position control for the separation supporting unit 40 will be described below with reference to FIG. 5B. During the raising operation of the separation supporting unit 40, the separation supporting unit 40 raises the transfer belt 24 to separate extremely thin recording material P therefrom.

Figure 5B:
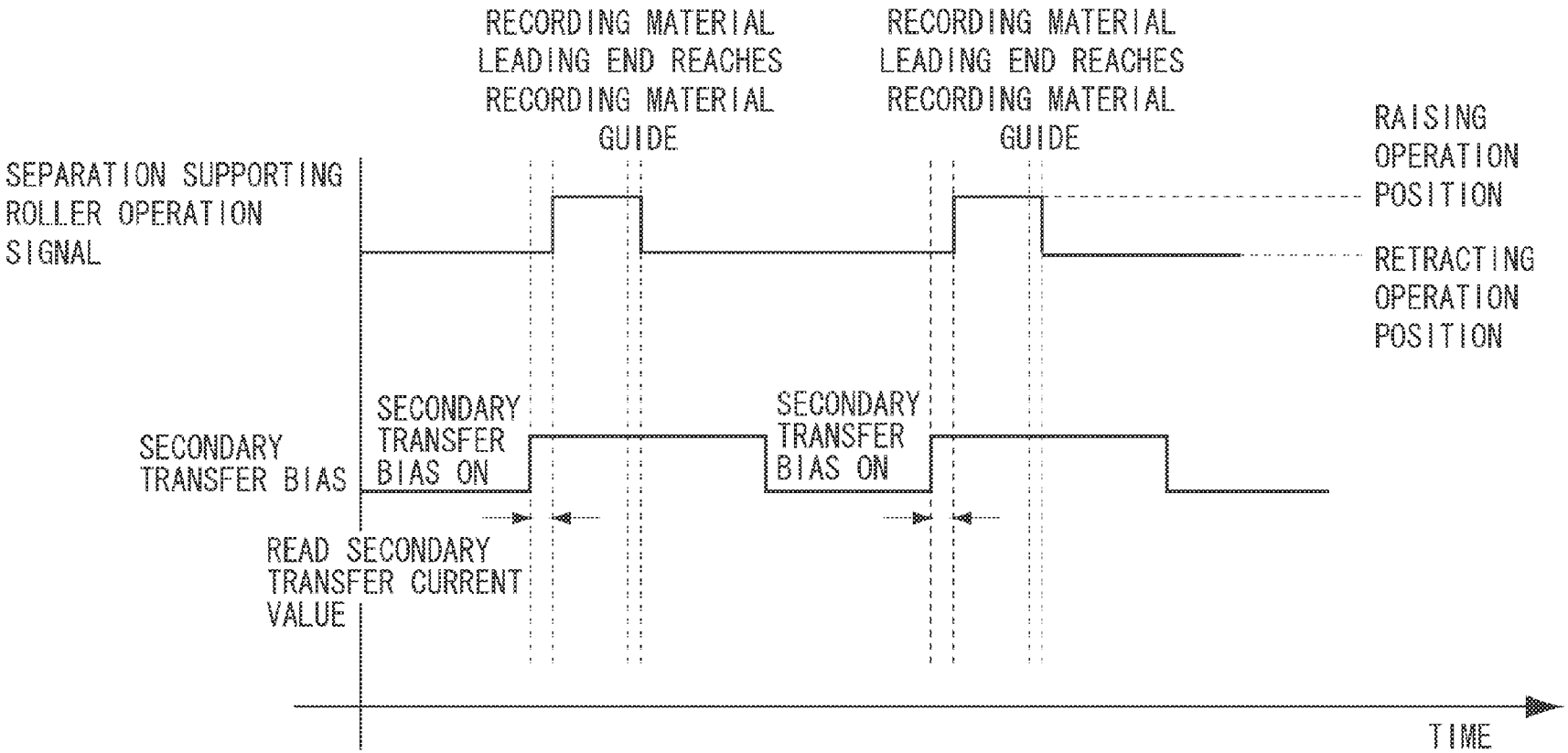

As illustrated in FIG. 5B, when the leading end of recording material P reaches the recording material guide 60, the control unit 50 transmits to the separation supporting unit 40 a signal for performing an operation for retracting the separation supporting unit 40 from the raising position where the transfer belt 24 is raised, to the retracting position.

The state where the transfer belt 24 is raised by the separation supporting unit 40 is illustrated in FIG. 2B, and the state where the separation supporting unit 40 is retracted is illustrated in FIG. 2A. Since the separation supporting unit 40 moves to the retracting position after completion of image formation, that is, when the recording material P is discharged from the image forming apparatus, the separation supporting unit 40 is located at the retracting position when the next image formation operation is started.

The control unit 50 determines whether the leading end of the recording material P has reached the recording material guide 29 via the recording material detection sensor provided on the recording material guide 29.

<Pre-Separation Stretching Roller>

The present invention is characterized by the pre-separation stretching roller 60 illustrated in FIG. 1. The configuration of the pre-separation stretching roller 60, which is a pre-separation stretching member disposed between the contact portion (between the separation supporting unit 40 and the transfer belt 24) and the secondary transfer portion N, will be described below.

The pre-separation stretching roller 60 for stretching the transfer belt 24 is disposed between the secondary transfer portion N and the separation supporting unit 40. In the present exemplary embodiment, the pre-separation stretching roller 60 is a straight roller made of stainless steel having a diameter of 8 mm. In the present exemplary embodiment, a straight roller made of stainless steel having a diameter of 8 mm is used. However, the pre-separation stretching roller 60 is not limited thereto, and may be a metal roller having such a stiffness that the pre-separation stretching roller 60 is not bent and that the belt surface of the transfer belt 24 becomes flat when the transfer belt 24 is stretched by the pre-separation stretching roller 60.

The pre-separation stretching roller 60 is a cylindrical roller having an axis direction perpendicular to the moving direction of the transfer belt 24. Further, the length of the pre-separation stretching roller 60 in the direction perpendicular to the moving direction is larger than the width of the transfer belt 24. The pre-separation stretching roller 60 contacts the inner side of the transfer belt 24. In the present exemplary embodiment, the position of the pre-separation stretching roller 60 is fixed.

Figure 6A:
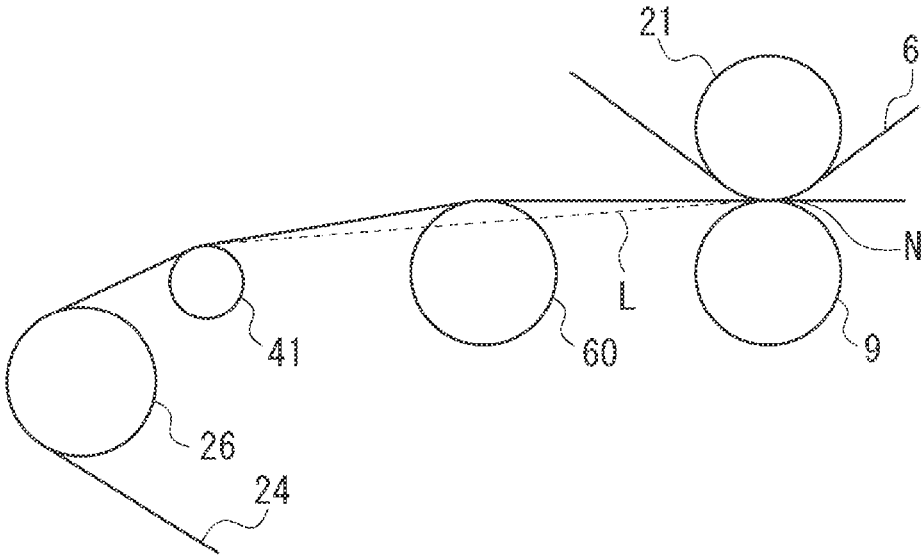
FIGS. 6A and 6B illustrate an arrangement of a pre-separation stretching roller.

Relations between the positions of the separation supporting rollers 41, the secondary transfer portion N, and the pre-separation stretching roller 60 are illustrated in FIG. 6A. The pre-separation stretching roller 60 reduces the influence of undulations on the transfer belt 24, produced when the separation supporting rollers 41 raise the transfer belt 24, on the secondary transfer portion N.

Figure 7:
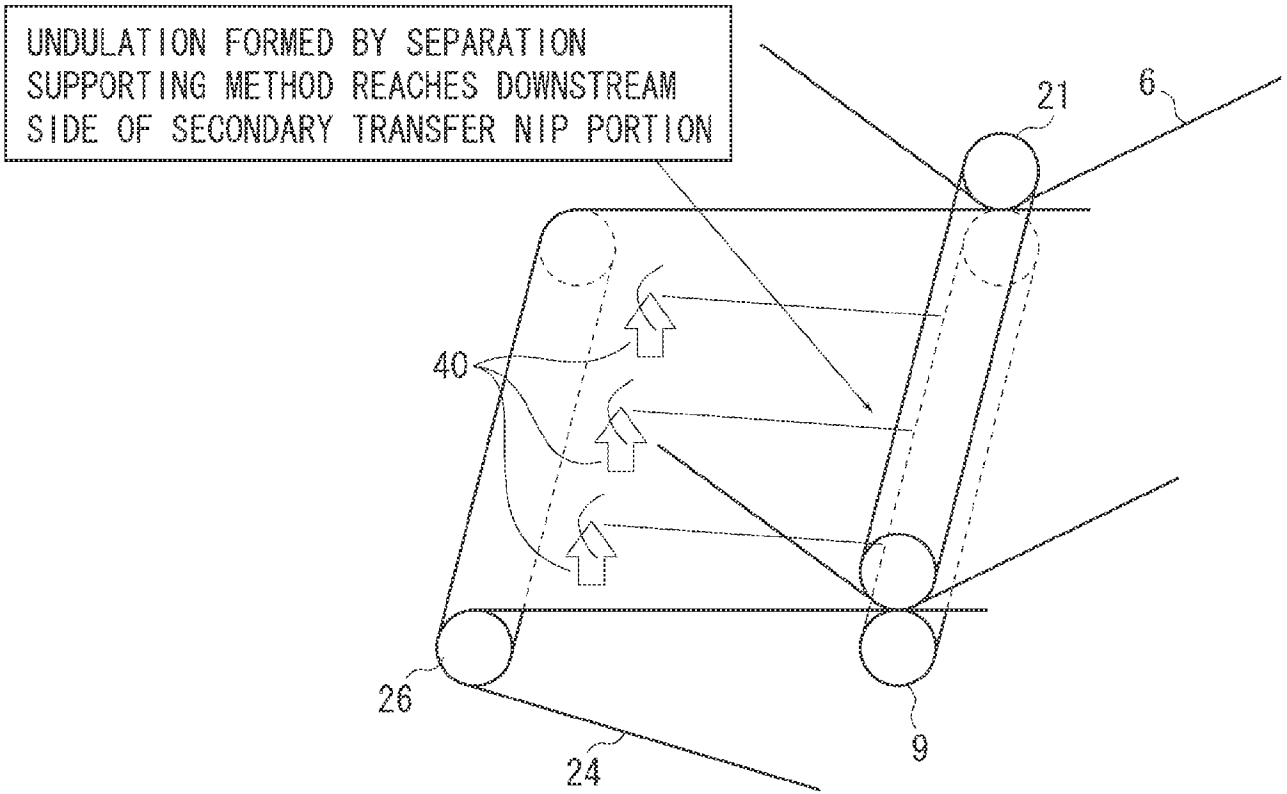
FIG. 7 is a schematic view illustrating undulations on the transfer belt by the separation unit.

Undulations on the transfer belt 24 are as illustrated in FIG. 7. Referring to FIG. 6A, when the pre-separation stretching roller 60 is not provided, the transfer belt 24 is stretched along a virtual straight line L, which passes the exit of the nip portion between the outer facing roller 9 and the inner facing roller 21, and circumscribes the inner circumferential surface of a separation supporting roller 41 in the raising state.

In this case, the undulations formed on the transfer belt 24 when the separation supporting unit 40 raises the separation supporting rollers 41 have an influence on the secondary transfer portion N. To eliminate the influence, the pre-separation stretching roller 60 stretches the transfer belt 24 between the secondary transfer portion N and the pre-separation stretching roller 60.

This configuration restrains undulations formed on the transfer belt 24 by the separation supporting rollers 41 from propagating to the upstream side of the pre-separation stretching roller 60 in the rotational direction of the transfer belt 24. Therefore, the contact portion between the pre-separation stretching roller 60 and the transfer belt 24 is located on the belt surface side (upper side) of the virtual straight line L in FIG. 6A.

By arranging the pre-separation stretching roller 60 at this position, the pre-separation stretching roller 60 contact the inner side of the transfer belt 24 over its entire width, thus preventing undulations on the transfer belt 24 from transmitting to the nip portion N.

As for the distance between the contact portion (between the pre-separation stretching roller 60 and the transfer belt 24) and the straight line L, the longer the distance, the larger the effect of stopping the propagation of undulations. The present exemplary embodiment, however, is configured so that a recording material P having any thickness passes through the stretching position of the pre-separation stretching roller 60. Therefore, if this distance is too long, the curvature of the pre-separation stretching roller 60 of the belt surface of the transfer belt 24 will increase.

As a result, when a thick recording material P is conveyed, the recording material P is separated from the transfer belt 24 at the portion of the pre-separation stretching roller 60 possibly degrading the conveyance performance, although the recording material P is normally separated by the stretching roller 26 disposed on the downstream side of the separation supporting rollers 41 in the moving direction of the transfer belt 24.

When the position of the pre-separation stretching roller 60 is raised too much, the belt surface formed by the position of the pre-separation stretching roller 60 and the secondary transfer portion N will be close to the intermediate transfer belt 6. As a result, the separatability between the recording material P and the intermediate transfer belt 6 at the secondary transfer portion N will be reduced.

To prevent the above-mentioned problems, in the present exemplary embodiment, the pre-separation stretching roller 60 is positioned so that the belt surface formed by the position of the pre-separation stretching roller 60 and the secondary transfer portion N is below an extension of a straight line connecting the leading and trailing ends of the nip portion of the secondary transfer portion N.

Figure 6B:
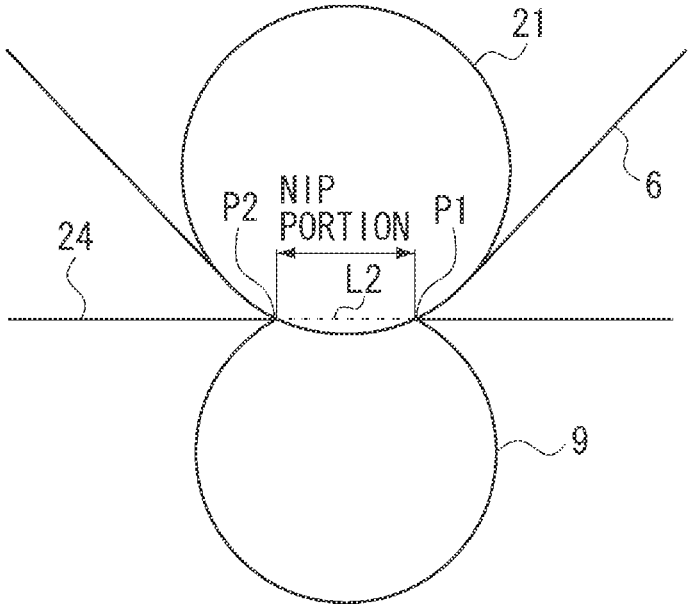

The straight line connecting the leading and trailing ends of the nip portion will be described below with reference to FIG. 6B. In the present exemplary embodiment, the hardness of the inner facing roller 21 and the intermediate transfer belt 6 is higher than the hardness of the outer facing roller 9. Therefore, the inner facing roller 21 has a nip shape at which the inner facing roller 21 gets into the outer facing roller 9 via the intermediate transfer belt 6.

A line L2 connecting a leading end P1 and a trailing end P2 of the nip portion is the above-mentioned straight line connecting the leading and trailing ends of the nip portion. In the present exemplary embodiment, the belt surface of the transfer belt 24 coincides with the extension of the straight line L2.

To attach importance to electrical influence by the outer facing roller 9, the pre-separation stretching roller 60 needs to be positioned so as to maintain a predetermined interval to the outer facing roller 9 at which discharge is not generated by the applied transfer voltage, on the upstream side of the transfer belt 24 in the moving direction of the transfer belt 24. Further, the interval between each separation supporting roller 41 and the pre-separation stretching roller 60 is desirably maximized as possible.

By arranging the pre-separation stretching roller 60 in this way, even when the separation supporting rollers 41 locally deform the transfer belt 24, the influence of the deformation of the transfer belt 24 on the transfer portion can be minimized.

Although the position of the pre-separation stretching roller 60 is fixed in the first exemplary embodiment, a moving mechanism 600 for moving the pre-separation stretching roller 60 is provided in a second exemplary embodiment. Since other elements are similar to those of the first exemplary embodiment, duplicated explanations will be omitted. Only portions different from the first exemplary embodiment will be described below.

The present exemplary embodiment is provided with the moving mechanism 600 for contacting and separating the pre-separation stretching roller 60 and transfer belt 24 in synchronization with contact and separation between the separation supporting rollers 41 of the separation supporting unit 40 and the transfer belt 24.

Figure 8:
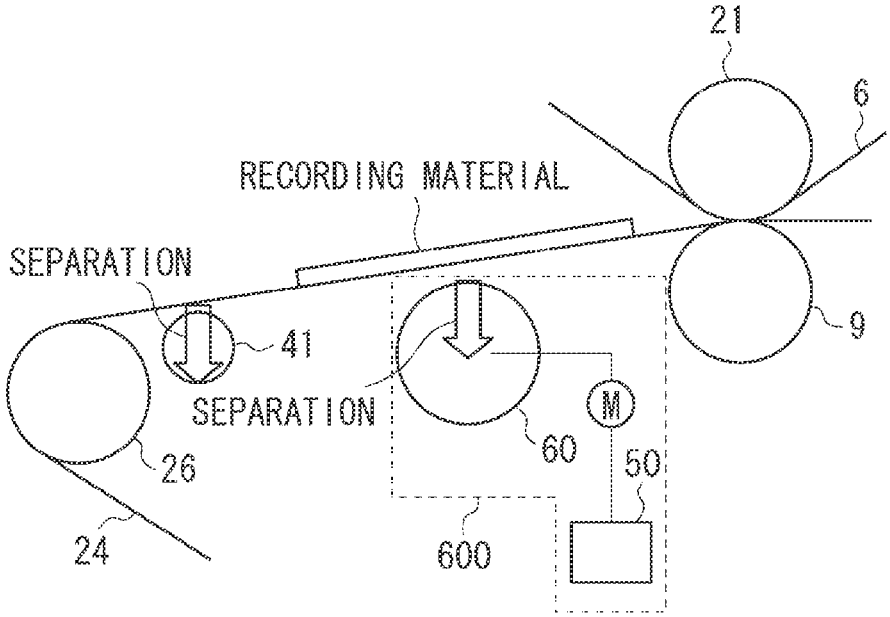
FIG. 8 illustrates a state where the pre-separation stretching roller is located at a retracting position according to a second exemplary embodiment of the invention.

The moving mechanism 600 is illustrated in FIG. 8. The moving mechanism 600 includes a motor M for moving the pre-separation stretching roller 60 to a transfer belt raising position (first position) and moving it from the first position to a retracting position (non-contact position in the present exemplary embodiment), based on a signal from the control unit 50.

With a thick stiff recording material, in a state where the pre-separation stretching roller 60 is constantly stretching the transfer belt 24 as is the case with the first exemplary embodiment, the recording material is separated from the transfer belt 24 on the belt surface having a curvature by the pre-separation stretching roller 60, possibly degrading the conveyance performance.

Therefore, in the present exemplary embodiment, when the separation supporting unit 40 activates the separation supporting rollers 41 to raise the transfer belt 24, the pre-separation stretching roller 60 is contacted with the transfer belt 24 to stretch the transfer belt 24.

When the separation supporting rollers 41 do not raise the transfer belt 24, the pre-separation stretching roller 60 is not raised. A state where the separation supporting rollers 41 raise the transfer belt 24 is illustrated in FIG. 6A.

Figure 9:
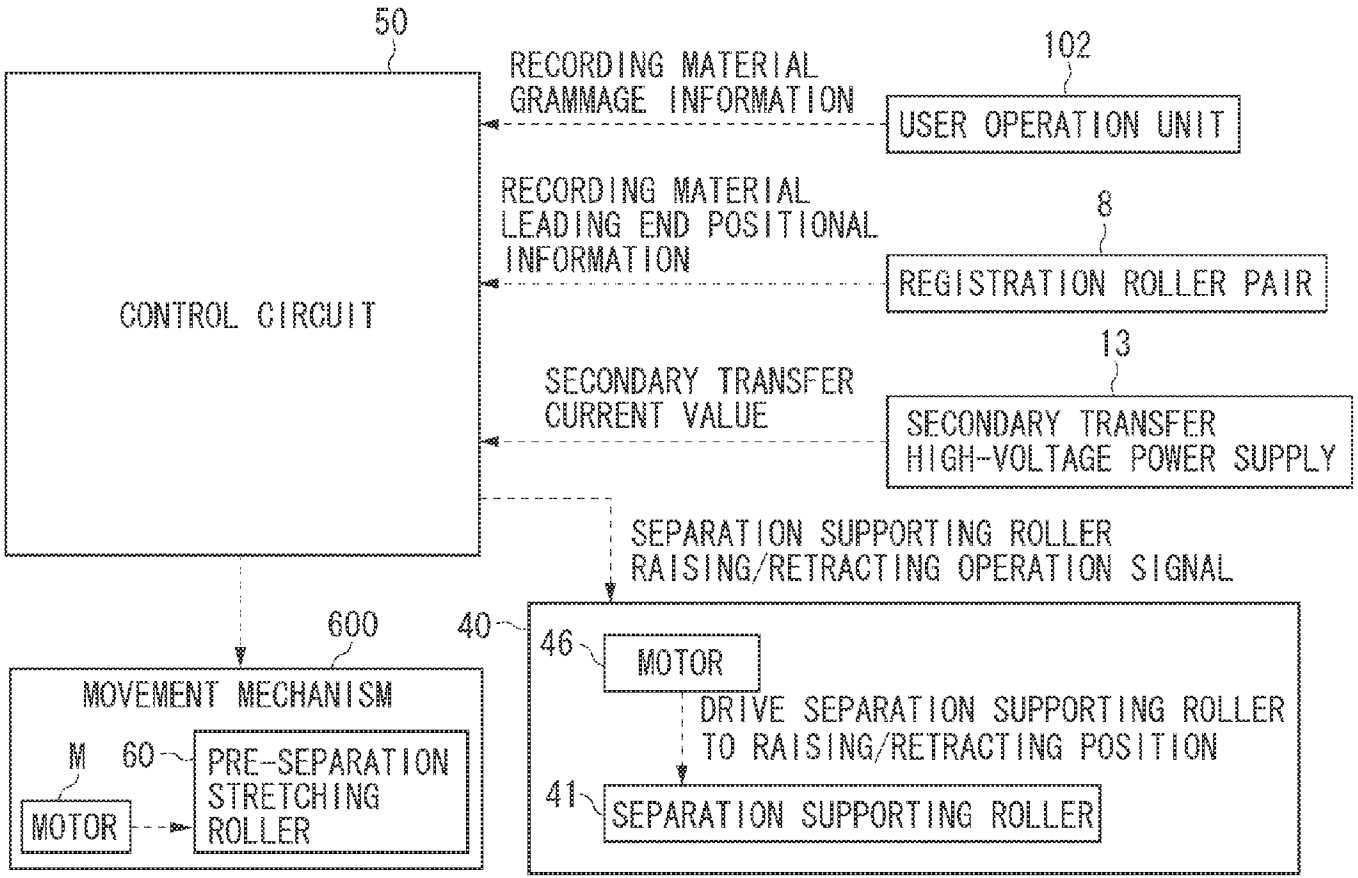
FIG. 9 is a block diagram illustrating the image forming apparatus according to the second exemplary embodiment.

A block diagram for the present exemplary embodiment will be described below with reference to FIG. 9. The present exemplary embodiment is similar to the first exemplary embodiment in the configuration of the control unit 50 and other units, and is different therefrom in that the moving mechanism 600 is provided. The operation of the motor M provided in the moving mechanism 600 is controlled by the control unit 50.

The raising and retracting operations of the pre-separation stretching roller 60 and the separation supporting rollers 41 will be described below with reference to the flow chart in FIG. 10.

In the present exemplary embodiment, the following two different patterns are pre-stored in the ROM in a similar way to the first exemplary embodiment.

With a grammage of 40 $g/m^2$ or less, the separation supporting rollers 41 locally deform the transfer belt 24.

With a grammage exceeding 40 $g/m^2$, the separation supporting rollers 41 are separated from the transfer belt 24.

Figure 10:
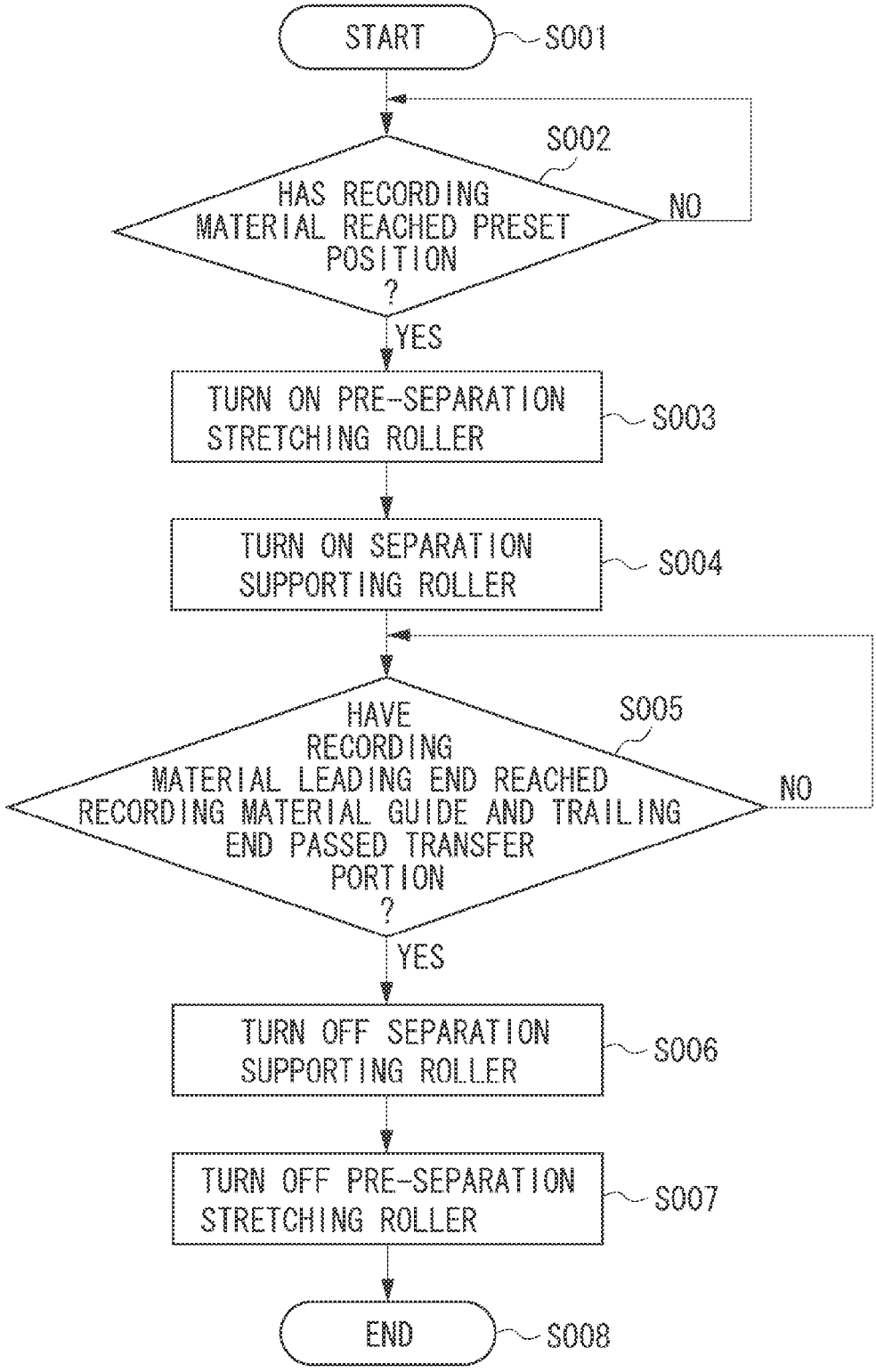
FIG. 10 is a flow chart illustrating processing by the second exemplary embodiment.

In step S001, the control unit 50 starts the processing of the flow chart in FIG. 10 when the separation supporting rollers 41 is raised. In step S002, the control unit 50 detects whether the recording material P has reached a predetermined position between the registration roller pair 8 and the secondary transfer portion N.

When the recording material reaches the secondary transfer portion N and then the pre-separation stretching roller 60 is raised (turned ON) (YES in step S002), the nip portion of the secondary transfer portion N is deformed by the raising of the transfer belt 24. When the nip portion is deformed while the recording material P is being fed therethrough, the transfer state changes, possibly causing a change in the image state. In step S003, to avoid a change in the image state, the control unit 50 drives the motor M to raise the pre-separation stretching roller 60 of the moving mechanism 600 before the recording material P reaches the secondary transfer portion N.

In step S004, the control unit 50 raises (turns ON) the separation supporting rollers 41. The control unit 50 raises the pre-separation stretching roller 60 before turning ON the separation supporting rollers 41. If the separation supporting rollers 41 is turned ON first, there may be a situation that undulations on the transfer belt 24 propagate to the secondary transfer portion N.

Subsequently, when the pre-separation stretching roller 60 is turned ON, there may be a situation that undulations remain between the pre-separation stretching roller 60 and the secondary transfer portion N. To avoid this problem, it is desirable to first turn ON the pre-separation stretching roller 60.

A time interval between the operation for raising the pre-separation stretching roller 60 and the operation for raising the separation supporting rollers 41 is preset. Specifically, the control unit 50 outputs a signal for activating the pre-separation stretching roller 60 and, after the preset time interval has elapsed, outputs a signal for raising the separation supporting rollers 41.

In the present exemplary embodiment, the present time interval is three seconds during which the pre-separation stretching roller 60 starts and reliably completes operation. However, this time interval is to be considered as an example. It is only necessary that the operation for raising the pre-separation stretching roller 60 is completed before the recording material P reaches the pre-separation stretching roller 60.

In step S005, the control unit 50 determines whether the leading end of the recording material P has reached the recording material guide 29 and the trailing end thereof has passed the secondary transfer portion N. In the present exemplary embodiment, the recording material detection sensor provided on the recording material guide 29 detects whether the leading end of the recording material P has reached the recording material guide 29. The method for detecting the recording material P is not limited to the recording material detection sensor.

When the control unit 50 determines that the trailing end of the recording material P has passed the secondary transfer portion N (YES in step S005), the processing proceeds to step S006. In step S006, the control unit 50 controls the motor 46 of the separation supporting unit 40 to move (turn OFF) the separation supporting rollers 41 to the retracting position.

In step S007, the control unit 50 controls the motor M of the moving mechanism 600 to move (turn OFF) the pre-separation stretching roller 60 to the retracting position. In step S008, the control unit 50 ends the processing. The control unit 50 turns OFF the separation supporting rollers 41 before turning OFF the pre-separation stretching roller 60 to prevent undulations by the separation supporting rollers 41 from propagating to the secondary transfer portion N.

When feeding in succession recording materials which need to activate the separation supporting rollers 41, it may be possible to perform successive image formation with the separation supporting rollers 41 and the pre-separation stretching roller 60 positioned in the raising position. In this case, the operation according to this flow chart may be performed when starting the movement to the raising position and the movement to the retracting position.

In the above-mentioned exemplary embodiments, the separation supporting rollers 41 are operated based on Table 1. However, the operation table is not limited thereto, but may be other tables for operating the separation supporting rollers 41 in association with other elements.

In the present exemplary embodiment, the intermediate transfer belt 6 contacts the transfer belt 24. However, the same effect can be obtained also by applying the configuration of the present invention to a transfer belt which contacts the photosensitive drums.

According to the present invention, a raising method raises the transfer belt to separate the recording material therefrom as mentioned above. This configuration enables minimizing the influence of the deformation of the transfer belt by the raising means on a transfer portion even with a short interval between the raising method and the transfer portion.

Although exemplary embodiments according to the present invention have specifically been described, the present invention is not limited thereto, but can be modified in various ways without departing from the spirit and scope thereof.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-256223 filed Nov. 9, 2009, which is hereby incorporated by reference herein in its entirety.

What is claimed is:

1. An image forming apparatus comprising:

an image bearing member;

a stretched rotatable belt member;

a transfer member configured to form a transfer portion for transferring a toner image formed on the image bearing member onto a recording material conveyed by the belt member;

a separation roller configured to stretch the belt member and enable separating the recording material borne by the belt member from the belt member;

a raising unit configured to enable locally raising a belt surface on the upstream side of the separation roller and on the downstream side of the transfer portion in the rotational direction of the belt member in the width direction of the belt member to separate the recording material borne by the belt member from the belt member; and a pre-separation stretching member disposed on the downstream side of the transfer portion and on the upstream side of a contact portion between the raising unit and the belt member in the rotational direction, and configured to stretch the belt member at least when the raising unit raises the belt member.

2. The image forming apparatus according to claim 1, wherein the pre-separation stretching member is movable between a stretching position where the belt member is stretched and a retracting position where the pre-separation stretching member is retracted from the stretching position.

3. The image forming apparatus according to claim 2, wherein the pre-separation stretching member moves from the retracting position to the stretching position before the recording material reaches the transfer portion, and wherein, after the pre-separation stretching member has moved to the stretching position, the raising unit starts operation for locally raising the belt member.

4. The image forming apparatus according to claim 2, wherein the transfer portion is a nip portion formed of a roller pair, and wherein a contact portion between the pre-separation stretching member and the belt member when the pre-separation stretching member is at the stretching position is above a straight line connecting a contact portion between the raising unit and the belt member when the raising unit is at the raising position, and an exit of the nip portion in the conveyance direction of the recording material.

5. The image forming apparatus according to claim 1, wherein the raising unit raises the belt member when a recording material having a preset stiffness is conveyed, and wherein, when the stiffness of the recording material is larger than the preset stiffness, the raising unit is positioned at a retracting position retracted from the raising position.

6. The image forming apparatus according to claim 1, wherein the position of the pre-separation stretching member is fixed.

* * * * *